United States Patent [19]

Garrett

[11] 4,291,464

[45] Sep. 29, 1981

[54] LID PIERCING DEVICE

[76] Inventor: Ernest R. Garrett, P.O. Box 3308, Granada Hills, Calif. 91344

[21] Appl. No.: 51,703

[22] Filed: Jun. 25, 1979

[51] Int. Cl.[3] ..... B26F 1/00

[52] U.S. Cl. ..... 30/363; 30/360

[58] Field of Search ..... 30/363, 360, 361

[56] References Cited

U.S. PATENT DOCUMENTS

| | | | |
|---|---|---|---|
| 187,896 | 2/1877 | Osborne | 30/363 |
| 317,181 | 5/1885 | Osborne | 30/363 |
| 759,709 | 5/1904 | Hart | 30/363 |
| 765,954 | 7/1904 | Bernard | 30/363 |
| 1,827,180 | 10/1931 | Williams | 30/363 |
| 3,274,687 | 9/1966 | Le Blanc | 30/360 |
| 3,392,447 | 7/1968 | Hendricks et al. | 30/363 |

FOREIGN PATENT DOCUMENTS

| | | | |
|---|---|---|---|
| 355236 | 5/1922 | Fed. Rep. of Germany | 30/363 |
| 499075 | 11/1919 | France | 30/363 |
| 505481 | 5/1920 | France | 30/363 |
| 234889 | 2/1945 | Switzerland | 30/363 |
| 1327 | of 1885 | United Kingdom | 30/363 |
| 7601 | of 1909 | United Kingdom | 30/363 |
| 556892 | 10/1943 | United Kingdom | 30/363 |

*Primary Examiner*—Stephen G. Kunin
*Assistant Examiner*—J. T. Zatarga
*Attorney, Agent, or Firm*—Wagner & Bachand

[57] ABSTRACT

An improved specialized punch designed to produce, in a single motion, one or more openings through a tough plastic lid of the type used as covers for disposable beverage cups. The punch employs a scissor action and includes a pair of handles having mating jaws one of which has one or more punching dies and the second, an anvil with matching openings arranged in an concave arcuate array. In one embodiment the main jaws include a stop which limits the advance of the jaws onto a lid and properly positions the jaws for piercing the lid. The jaw likewise includes a guide which holds the upstanding rim of the lid for precise positioning during punching. In another embodiment the punch presents the appearance of an office stapler and includes an arcuate shaped male cutting die and a plurality of guide grooves for different size lids.

4 Claims, 9 Drawing Figures

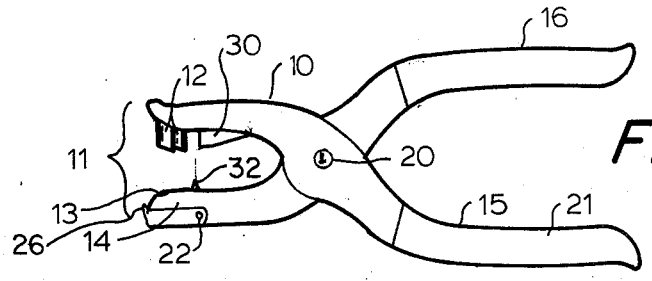
FIG. 1
FIG. 2
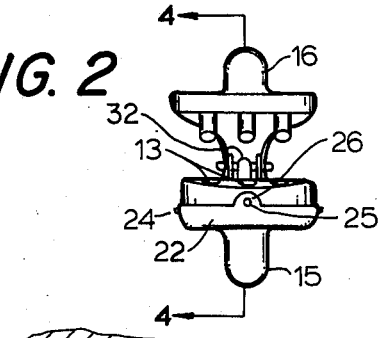
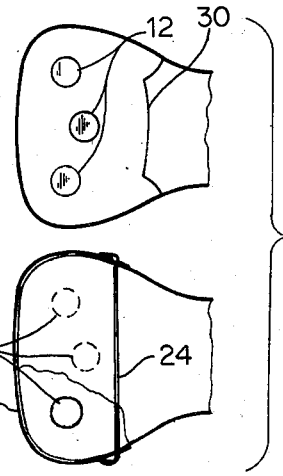
FIG. 3
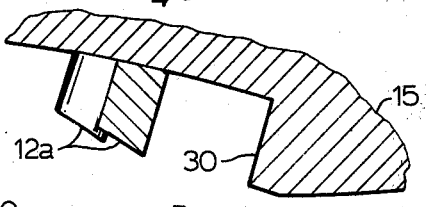
FIG. 4
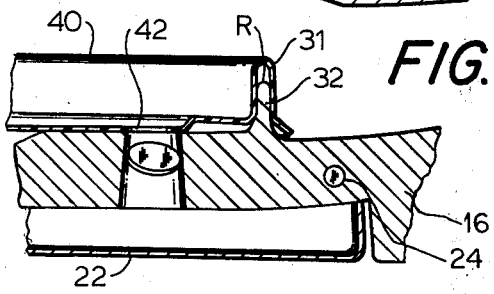
FIG. 9
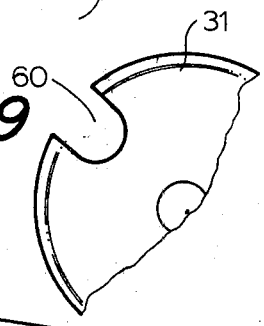
FIG. 6
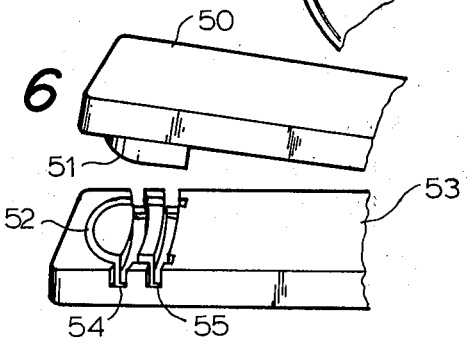
FIG. 5
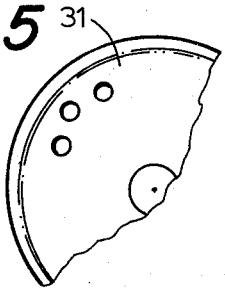
FIG. 7
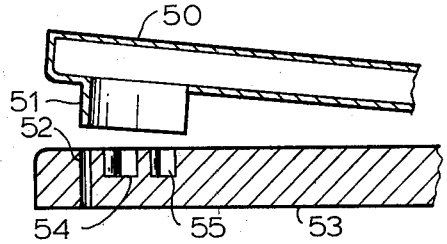
FIG. 8
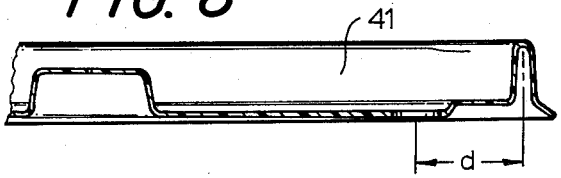

LID PIERCING DEVICE

BACKGROUND OF THE INVENTION

One of the problems of transporting liquids in disposable cups, such as coffee cups, where it is the intention that the coffee be consumed away from the premises is the need for an effective lid or cap for the liquid container. A typical example is the well known styro-foam cup and its mating snap-on formed plastic lid. At the time the user desires to consume the liquid, he must carefully remove the snap-on cap or lid for drinking the contents. If the contents happened to be hot coffee and the user is in a moving vehicle such as an automobile, or inattentive, the end result is usually spillage, and a possible accident.

Some people have taken to leaving the lid in place and punching a hole in the lid, using whatever sharp instrument is available, and then attempting to drink the fluid through the punched out hole.

Some lids are pre-punched with openings designed to receive a straw. Such holes, however, are usually centered and require the use of a straw for any significant amount of fluid to be withdrawn from the container into the user's mouth. This arrangement is useless for the coffee drinker.

Although disposable drinking cups are usually made of styro-foam or paper which is easily perforated, the lids are usually made of polystyrene, polyethylene, or polypropylene. These are relatively tough materials and not easily perforated outside of the factory. Thus perforation by the user or the vendor using the pointed instrument such as a knife, can be dangerous.

BRIEF STATEMENT OF THE INVENTION

Faced with the foregoing problem, I have devised an improved punch designed specifically to produce one or more openings in a plastic lid by one simple stroke without any danger to the user as compared with using sharp instruments. I have also devised such a punch which automatically positions the punch jaws with respect to the edge rim of the lid to provide drinking openings at the correct distance from the edge.

I have further provided a punch which provides an arcuate punch-out in any of a number of sizes of lids.

These objectives are all accomplished in accordance with this invention, of which one embodiment comprises a scissor like hand punch having a pair of mating jaws. One of the jaws includes a plurality of male die punches and the other jaw an apertured anvil constituting the female die. The punches and apertures are arranged in an arcuate array just inside the rim to avoid interference with the normal snap locking of the lid on the cup, yet convenient for the user in consuming the liquid contained in the cup without removing of the lid.

In one embodiment, a punch includes a stop to properly position the die within the rim. In another embodiment the guide mates with the lid rim to affect its positioning and ensure solid support for the lid during punching. A punch out trap is pivotally secured to the anvil jaw to capture punch outs.

In another embodiment the assembly has the general appearance of a desk stapler with a single arcuate male die and a plurality of arcuate recesses for receiving the inverted lid rim, in addition to the female die.

BRIEF DESCRIPTION OF THE DRAWINGS

This invention may be more clearly understood from the following detailed description and by reference to the drawings in which:

FIG. 1 is a side elevational view of an embodiment of this invention;

FIG. 2 is a front elevational view thereof;

FIG. 3 is a fragmentary view of the die set of the embodiment of FIGS. 1 and 2 with portions broken away for clarity;

FIG. 4 is a fragmentary longitudinal sectional view of the jaw portion of the embodiment of FIGS. 1 through 3 taken along line 4—4 of FIG. 2;

FIG. 5 is a top view of a fragment of a lid of a beverage container having been pierced employing the punch assembly of the invention;

FIG. 6 is a perspective view of an alternative embodiment of this invention;

FIG. 7 is a fragmentary longitudinal sectional view of the embodiment of FIG. 6 taken along line 7—7 of FIG. 6;

FIG. 8 is a sectional view of a beverage container lid perforated by this invention; and FIG. 9 is a top view of a fragment of a lid pierced by the embodiment of FIGS. 6 and 7.

DETAILED DESCRIPTION OF THE INVENTION

Now referring to FIGS. 1 through 3, a lid piercer 10 of this invention may be seen as including a jaw assembly 11 mounting a plurality of male dies 12 and a matching set of apertures 13 in the anvil portion 14. The dies 12 and anvil 14 are each continuations of respective handles 15 and 16 joined together by a rivet or pivot 20 in the general appearance of a conventional punch or pliers or scissors. The handles 15 and 16 may include advertising or other identifying logo 21 on their side and may be fabricated metal or in certain cases of high impact plastic material. The dies 12 and anvil assembly 14, including the female die, however, are preferably of metal capable of holding a cutting edge.

The dies 12 preferably three in number, and arranged in an arcuate array as is more clearly shown in FIG. 3. The arc of the dies preferably has a diameter in the order of three to four inches depending upon the diameter of the lid with which the punch of this invention is designed to be used. A three inch diameter has been found to be eminently satisfactory to match the common lid diameter of three inches.

On the under side of anvil 14 is a pivoted punch trap 22 best seen in FIG. 4. It is preferably hinged on pin 24 and held in a closed position by a detent 25 forming an integral part of an upward extending tab 26 appearing in FIGS. 1 and 2 but unshown in FIG. 3. The trapping of punchings in this invention is important since punch out, which might remain in the lid, could conceivably enter the beverage and be unintentionally ingested by the user. Therefore, trapping or removing of the punch out is desirable. The jaw portion of the embodiments FIGS. 1 through 3 is large, allowing the trap or magazine to hold many punch outs before needing to be unloaded.

As indicated above, beverage lids are commonly manufactured from relatively tough plastic material such as polystyrene, polyethylene, or polypropylene. The lid materials resist deformation and punching and therefore the design of the punch which is effective, reliable and safe is important. FIGS. 1 through 4 show a feature of this invention which ensures such reliable and safe operation.

Now referring to FIGS. 1 and 4 particularly, the handle 16 includes an integral stop 30 designed to engage the outer cylindrical face of the lid rim portion designated 31 in FIG. 4. The lower jaw forming a part of the handle 16 includes an upstanding arcuate guide 32. The guide 32 slips into the rim 31 groove of the lid, which is generally designated 40. The guide 32 is preferably arcuate having a radius of curvature substantially corresponding to the radius of the hollow edge rim of the lid and extends over an arc of approximately 15° of the lid rim 31 to provide a secure positioning aid for the lid 40. For a 3 inch diameter lid, a 15 degree arc equals approximtely 0.4 in.

Employing the punch of FIGS. 1–3 with the stop 30 and guide, best seen in FIG. 4, the user merely inserts the lid, or other disc-like frangible member with its top side up into the jaws until the rim strikes stop 30. Next lowering the lid, the rim will fall over the guide 32 and the lid is precisely positioned for piercing. Squeezing the handle 15 and 16 causes the male dies 12 to punch out holes in an arcuate array inside the rim as shown in FIG. 5. The punch outs are captured in the magazine or trap 22. On opening of the jaws the lid is removable and ready for placing on a cup of liquid.

In certain cases, I have found, that a need exists for a fixed punch rather than a plier type as illustrated in FIG. 1. I have therefore devised an additional embodiment shown in FIGS. 6 and 7 which operate similar to a desk stapler. In this case the upper moveable arm 50 includes a single arcuate cutter blade 51 which mates with an arcuate groove 52 in the base 53. The cutter blade 51 and groove 52 cooperate to produce an arcuate cutout 60 of the type illustrated in FIG. 9, extending through the lid rim. This arcuate cut out 60 interupts the rim 31 and provides a clear uninterupted opening for consuming the beverage.

The embodiment of FIGS. 6 and 7 also is capable of accepting lids of at least two different sizes. In this case, the lid if inverted and slipped into the jaws of the punch until the rim drops into a matching groove 54 or 55. These grooves 54 and 55 both intersect with the female punch groove 52 insuring that the punch will always penetrate the entire rim 31.

Preferably the base is fabricated solid metal with the grooves 52, 53, and 54 milled therein to provide sufficient strength at the intersections of the grooves for clean severing of the punch outs. In this case the magazine for collecting punch outs may be located in the arm 50.

In each of these embodiments I have produced an effective punch for beverage container lids allowing the rapid perforation of tough lid materials with little danger to the user. Precise positioning of the lid is accomplished in each embodiment.

The above described embodiments of this invention are merely descriptive of its principles and are not to be considered limiting. The scope of this invention instead shall be determined from the scope of the following claims, including their equivalents.

I claim:

1. A punch assembly for piercing a thin disc-like frangible member including a hollow upstanding rim edge defining an edge groove comprising:

a male die including at least one punch;

a female die including at least one opening mating with said punch;

means securing said male and female dies for closing movement about a pivot point and defining a jaw-like opening; and a guide secured to one of said dies extending into the region between said dies and positioned within said jaw-like opening between said punch and said pivot and adapted to extend into the edge groove of the hollow edge rim of a thin disc-like frangible member to be pierced;

stop means secured to the opposite one of said dies from said guide and extending into said jaw-like opening;

said guide and stop means cooperating to limit the insertion of the frangible member into the punch assembly to position said thin disc-like frangible member for piercing by said die punch assembly.

2. The combination in accordance with claim 1 wherein said guide is arcuate having a radius corresponding to the radius of the edge groove of the hollow edge rim of a thin disc-like frangible member including a hollow upstanding rim edge to be pierced by said punch assembly.

3. The combination in accordance with claim 1 wherein said male die comprises a plurality of discrete-punches arranged in an arcuate array with the center of the arc outside of the jaw-like opening of said punch assembly.

4. The combination in accordance with claim 3 wherein said arc is substantially circular and having a center approximating the center of a frangible member when positioned in said punch assembly.

* * * * *